US010519818B2

(12) United States Patent
Kim et al.

(10) Patent No.: US 10,519,818 B2
(45) Date of Patent: Dec. 31, 2019

(54) VALVE DURATION CONTROL APPARATUS AND ENGINE PROVIDED WITH THE SAME

(71) Applicants: Hyundai Motor Company, Seoul (KR); Kia Motors Corporation, Seoul (KR)

(72) Inventors: Kyung Mo Kim, Hwaseong-si (KR); Kyoung Pyo Ha, Seongnam-si (KR); You Sang Son, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 1058 days.

(21) Appl. No.: 14/956,013

(22) Filed: Dec. 1, 2015

(65) Prior Publication Data

US 2017/0081989 A1 Mar. 23, 2017

(30) Foreign Application Priority Data

Sep. 21, 2015 (KR) ..... 10-2015-0133339

(51) Int. Cl.
*F01L 1/26* (2006.01)
*F01L 1/053* (2006.01)
*F01L 1/18* (2006.01)

(52) U.S. Cl.
CPC ..... *F01L 1/267* (2013.01); *F01L 1/053* (2013.01); *F01L 1/18* (2013.01); *F01L 2001/0535* (2013.01)

(58) Field of Classification Search
CPC ..... F01L 13/0026; F01L 1/053; F01L 1/08; F01L 1/18; F01L 1/181; F01L 1/20; F01L 1/267; F01L 1/356; F01L 2001/0535; F01L 2013/103; F01L 2820/01
USPC ..... 123/90.16, 90.15
See application file for complete search history.

(56) References Cited

FOREIGN PATENT DOCUMENTS

| | | | |
|---|---|---|---|
| CN | 103758605 | A | 4/2014 |
| CN | 104727875 | A | 6/2015 |
| CN | 104727879 | A | 6/2015 |
| JP | 6-185321 | A | 7/1994 |
| JP | 2009-236010 | A | 10/2009 |
| KR | 10-2013-0063819 | A | 6/2013 |

*Primary Examiner* — Mark A Laurenzi
*Assistant Examiner* — Paul W Thiede
(74) *Attorney, Agent, or Firm* — Morgan, Lewis & Bockius LLP

(57) ABSTRACT

A continuous variable valve duration system may include a camshaft, a first cam portion including a first cam, into which the camshaft is inserted and of which a relative phase angle of the first cam with respect to the camshaft is variable, a rocker shaft disposed parallel to the camshaft, a first rocker arm rotatably disposed to the rocker shaft of which a first end contacts with the first cam and a second end is connected to a first valve, an inner bracket to transmit rotation of the camshaft to the first cam portion, a slider housing into which the inner bracket is rotatably inserted, on which a control hole is formed and on which a guide portion is formed for guiding movement of the slider housing, an eccentric shaft inserted into the control hole, and a control portion to selectively rotate the eccentric shaft.

21 Claims, 13 Drawing Sheets

VALVE DURATION CONTROL APPARATUS AND ENGINE PROVIDED WITH THE SAME

CROSS-REFERENCE TO RELATED APPLICATION

The present application claims priority to Korean Patent Application No. 10-2015-0133339 filed Sep. 21, 2015, the entire contents of which is incorporated herein for all purposes by this reference.

BACKGROUND OF THE INVENTION

Field of the Invention

The present invention relates to a continuous variable valve duration apparatus/system and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus/system and an engine provided with the same which may vary opening duration of a valve according to operation conditions of an engine, with a simple construction.

According to various aspects of the present invention, a continuous variable valve duration system may include a camshaft, a first cam portion including a first cam, into which the camshaft is inserted and of which a relative phase angle of the first cam with respect to the camshaft is variable, a rocker shaft disposed parallel to the camshaft, a first rocker arm rotatably disposed to the rocker shaft of which a first end contacts with the first cam and a second end is connected to a first valve, an inner bracket configured to transmit rotation of the camshaft to the first cam portion, a slider housing into which the inner bracket is rotatably inserted, on which a control hole is formed and on which a guide portion is formed for guiding movement of the slider housing, an eccentric shaft inserted into the control hole, and a control portion configured to selectively rotate the eccentric shaft for the slider housing to be moved.

First and second slots may be formed to the inner bracket, in which the first cam portion comprises a wheel on which a wheel key is formed and connected to the first cam, and the continuous variable valve duration system may further include a connecting pin connected to the camshaft, a first slider pin on which a pin slot where the wheel key is slidably inserted thereto along a length direction of the wheel key is formed and the first slider pin is rotatably inserted into the first slot, and a second slider pin on which a pin hole where the connecting pin is slidably inserted thereto along a length direction of the connecting pin is formed and the second slider pin rotatably is inserted into the second slot.

The continuous variable valve duration system may further include a bearing disposed between the slider housing and the inner bracket.

The control portion may include a control gear connected to the eccentric shaft, and a control motor configured to selectively rotate the control gear.

The continuous variable valve duration system may further include a first bridge connected to the second end of the first rocker arm, wherein two first valves are connected to the first bridge.

The continuous variable valve duration system may further include a first roller connected to the first end of the first rocker arm and contacting the first cam.

The continuous variable valve duration system may further include an outer shaft into which the camshaft is inserted and wherein the first cam may be connected to the outer shaft.

The continuous variable valve duration system may further include a second cam portion including a second cam rotating with the same phase angle of the camshaft, and a second rocker arm rotatably connected to the rocker shaft, a first end of which contacts the second cam and a second end of which is connected with a second valve.

The continuous variable valve duration system may further include a second bridge connected to the second end of the second rocker arm, in which two second valves are connected to the second bridge.

The continuous variable valve duration system may further include a second roller connected to the first end of the second rocker arm and contacting the second cam.

The continuous variable valve duration system may further include an outer shaft on which a guide slot is formed and into which the camshaft is inserted, and a cam pin may be connected to the second cam and the cam pin may be inserted into the guide slot for guiding rotation of the second cam, and the first cam may be connected to the outer shaft.

According to various aspects of the present invention, an engine may include a camshaft, a first cam portion including a first cam, of which the camshaft is inserted therein and of which relative phase angle of the first cam with respect to the camshaft is variable, a rocker shaft disposed parallel to the camshaft, a first rocker arm rotatably disposed on the rocker shaft of which a first end contacts the first cam and a second end is connected to a first valve, an inner bracket configured to transmit rotation of the camshaft to the first cam portion, a slider housing of which the inner bracket is rotatably inserted therein, of which a control hole is formed thereto and of which a guide portion is formed thereto for guiding movement of the slider housing, an eccentric shaft inserted into the control hole, a control portion configured to selectively rotate the eccentric shaft for the slider housing to be moved, and a cam cap supporting the eccentric shaft and mounted to a cylinder head.

The engine may further include a bearing disposed between the slider housing and the inner bracket.

The engine may further include a first bridge connected to the second end of the first rocker arm, in which two first valves are connected to the first bridge.

The engine may further include an outer shaft on which a guide slot is formed and into which the camshaft is inserted, and the first cam may be connected to the outer shaft.

The engine may further include a second cam portion comprising a second cam connected to the camshaft through the guide slot, and a second rocker arm rotatably connected to the rocker shaft, of which a first end contacts the second cam and a second end is connected with a second valve.

The engine may further include a second bridge connected to the second end of the second rocker arm, and two second valves may be connected to the second bridge.

The engine may further include a first roller connected to the first end of the first rocker arm and contacting the first cam, and a second roller connected to the first end of the second rocker arm and contacting with the second cam.

A guide rail may be formed to the cam cap for guiding movement of the slider housing.

As described above, a continuous variable valve duration system according to various embodiments of the present invention may vary an opening duration of a valve according to operation conditions of an engine, with a simple construction.

The continuous variable valve duration system according to various embodiments of the present invention may be reduced in size and thus the entire height of a valve train may be reduced.

Since the continuous variable valve duration system may be applied to an existing engine without excessive modification, thus productivity may be enhance and production cost may be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
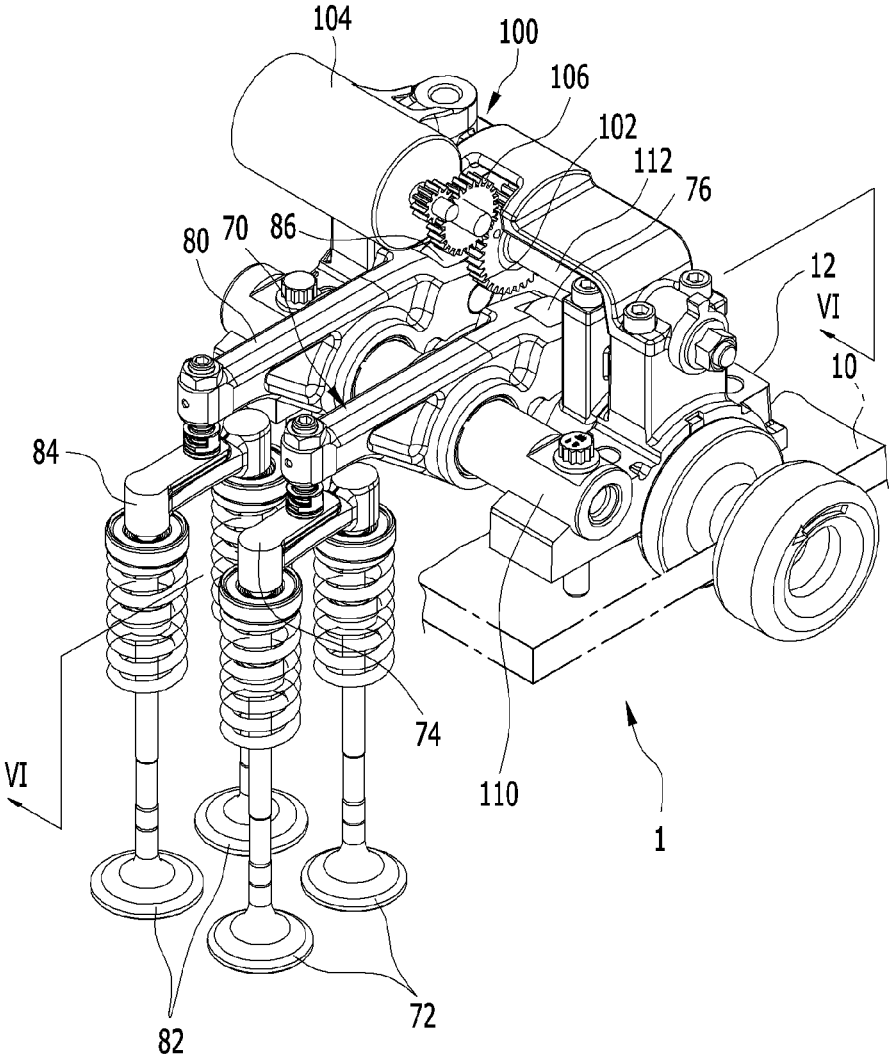
FIG. 1 is a perspective view of an engine provided with an exemplary continuous variable valve duration apparatus/system according to the present invention.
Figure 2:
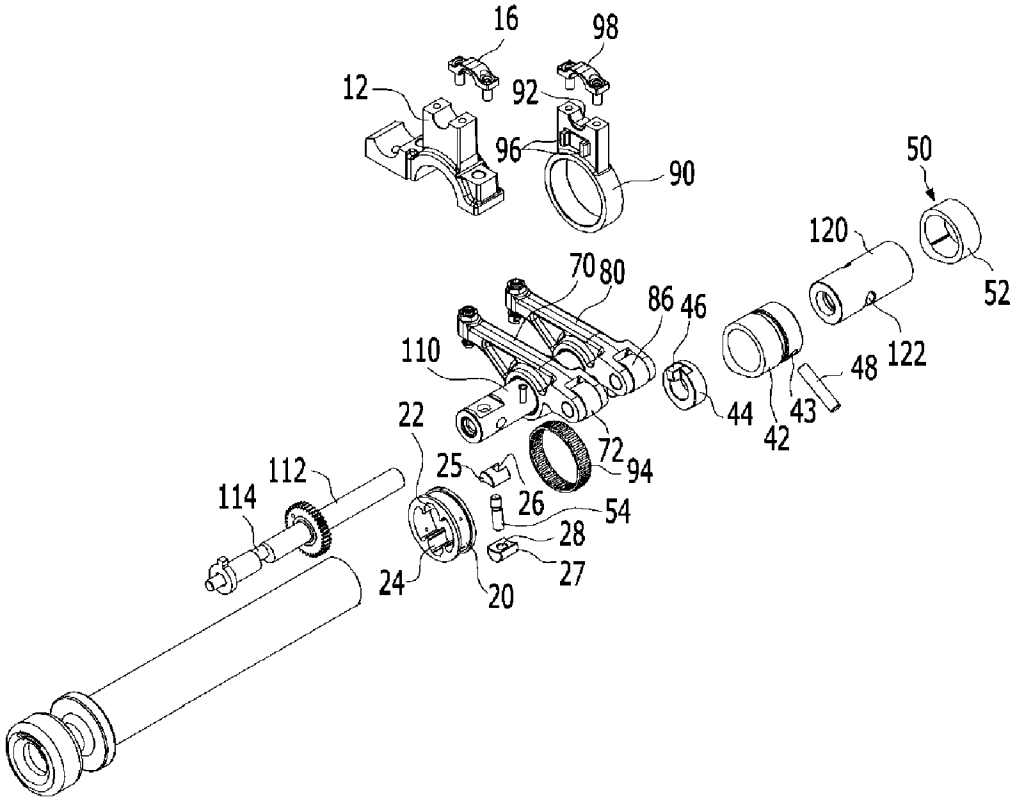
FIG. 2, FIG. 3, and FIG. 4 are partial exploded perspective views of the exemplary continuous variable valve duration system according to the present invention.
Figure 3:
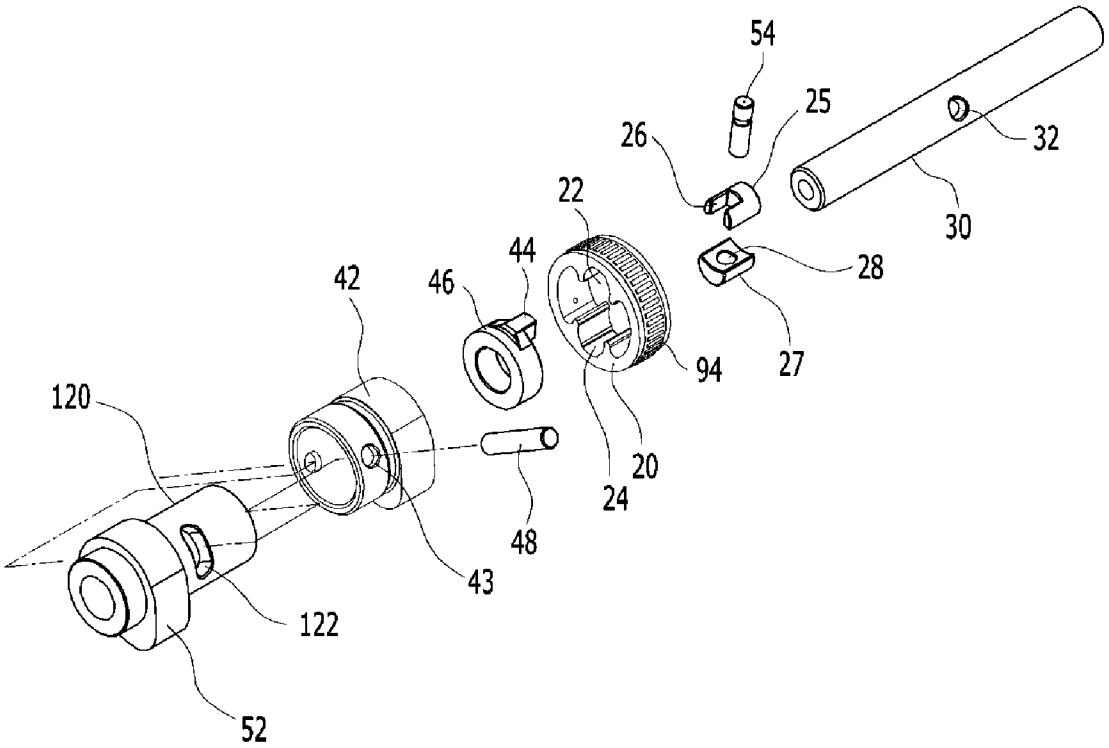
Figure 4:
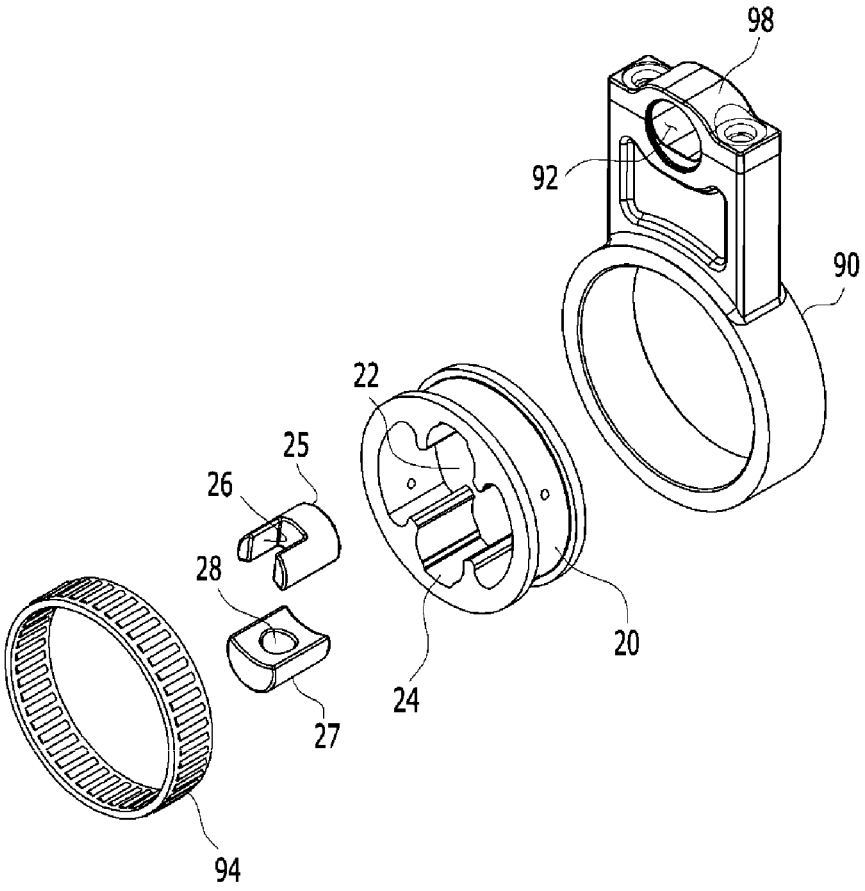

FIG. 1 is a perspective view of an engine provided with a continuous variable valve duration system according to various embodiments of the present invention and FIG. 2 to FIG. 4 are partial exploded perspective views of a continuous variable valve duration system according to various embodiments of the present invention.

Figure 5:
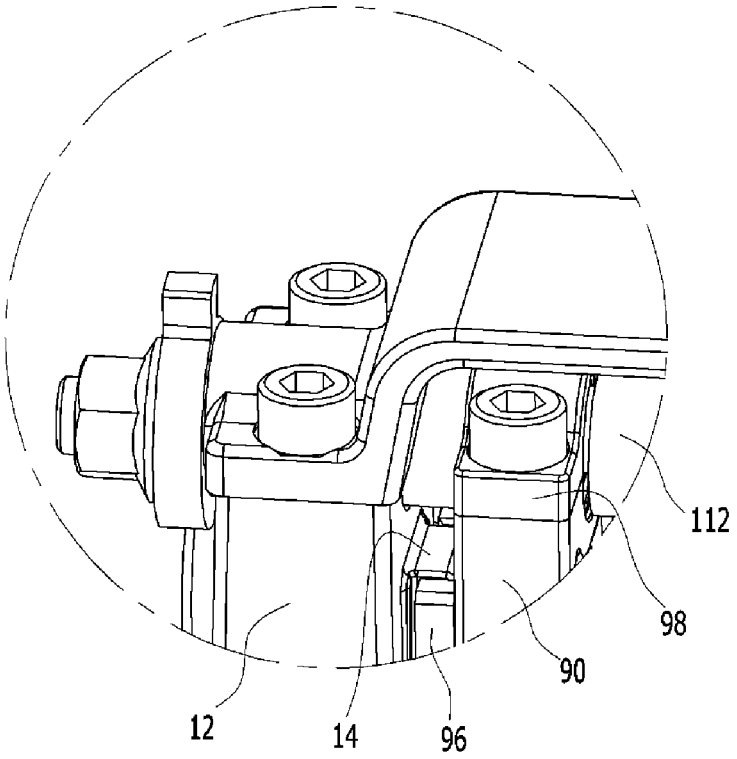
FIG. 5 is a partial exploded perspective view of a cam cap provided to the exemplary continuous variable valve duration apparatus/system according to the present invention.
Figure 6A:
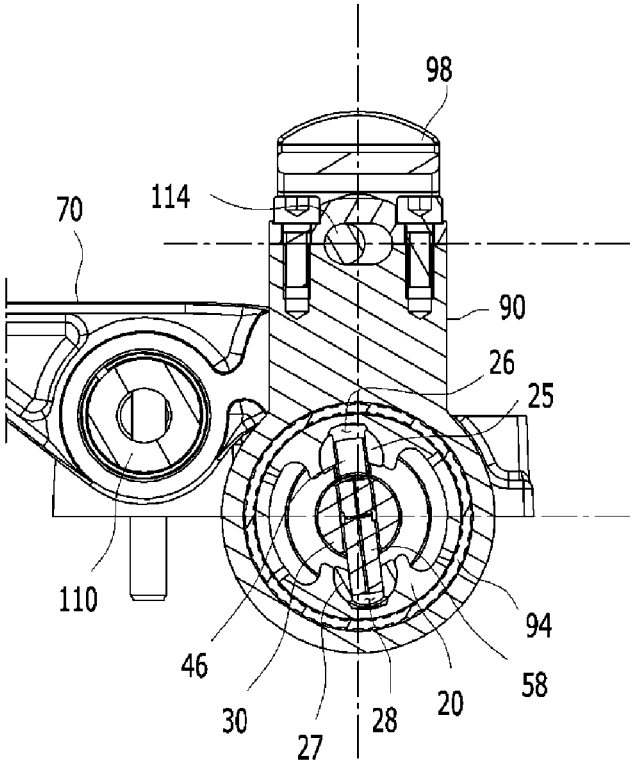
FIG. 6A and FIG. 6B are cross-sectional views along line VI-VI of FIG. 1.
Figure 6B:
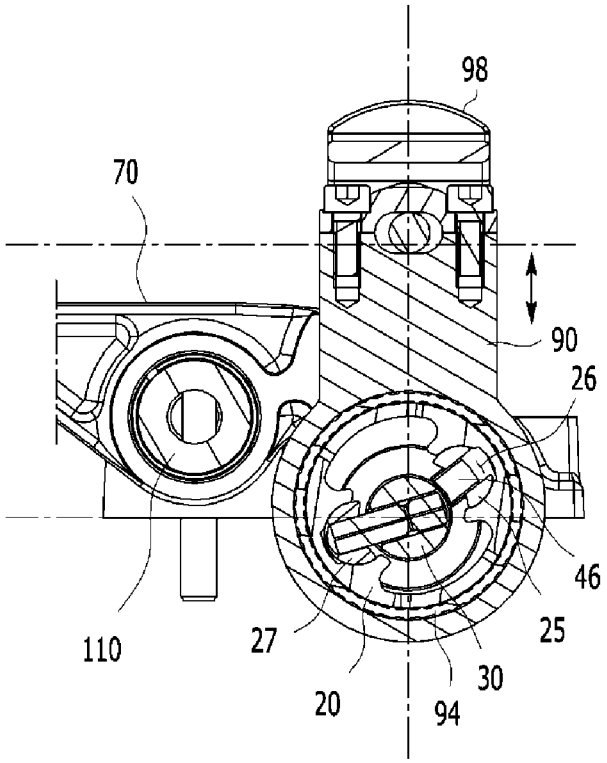

FIG. 5 is a partial exploded perspective view of a cam cap provided to a continuous variable valve duration system according to various embodiments of the present invention and FIGS. 6A and 6B are cross-sectional views along line VI-VI of FIG. 1.

Referring to FIG. 1 to FIG. 6, an engine 1 according to various embodiments of the present invention includes a cylinder head 10 and a continuous variable valve duration system mounted to the cylinder head 10 through a cam cap 12. In the detailed description and claims, the cylinder head 10 may include a cam carrier.

The continuous variable valve duration system includes a camshaft 30, a first cam portion 40 including a first cam 42, of which the camshaft 30 is inserted therein and of which relative phase angle of the first cam 42 with respect to the camshaft 30 is variable, a rocker shaft 110 disposed parallel to the camshaft 30, a first rocker arm 70 rotatably disposed to the rocker shaft 110 of which an end contacts with the first cam 42 and of which the other end is connected to a first valve 72, an inner bracket 20 transmitting rotation of the camshaft 30 to the first cam portion 40, a slider housing 90 of which the inner bracket 20 is rotatably inserted therein, of which a control hole 92 is formed thereto and of which a guide portion 96 is formed thereto for guiding movement of the slider housing 90, an eccentric shaft 112 inserted into the control hole 92 and a control portion 100 selectively rotating the eccentric shaft 112 for the slider housing 90 to be moved.

A slider housing cam 98 may be connected to the slider housing 90 for forming the control hole 92.

An eccentric rod 114 of the eccentric shaft 112 is inserted into the control hole 92 and relative position of the slider housing 90 with respect to the camshaft 30 is controlled.

A cam cap cover 16 is connected to the cam cap 12 for supporting the eccentric shaft 112.

First and second slots 22 and 24 are formed to the inner bracket 20.

The first cam portion 40 includes a wheel 44 of which a wheel key 46 is formed thereto.

A camshaft hole 32 is formed to the camshaft 30 and a connecting pin 54 is connected to the camshaft 30 through the camshaft hole 32.

A first slider pin 25 of which a pin slot 26 where the wheel key 46 is slidably inserted thereto along a length direction of the wheel key 46 is formed to the first slider pin 25 and the first slider pin 52 is rotatably inserted into the first slot 22. A second slider pin 27 of which a pin hole 28 where the connecting pin 54 is slidably inserted thereto along a length direction of the connecting pin 54 is formed to the second slider pin 27 and the second slider pin 27 is rotatably inserted into the second slot 24.

A bearing 94 is inserted between the slider housing 90 and the inner bracket 20. Thus, rotation of the inner bracket 20 may be easily performed.

The continuous variable valve duration system according to various embodiments of the present invention further include a second cam portion 50 including a second cam 52 rotating with the same phase angle of the camshaft 30 and a second rocker arm 80 rotatably connected to the rocker shaft 110, of which an end contacts with the second cam 52 and of which the other end is connected with a second valve 82.

The camshaft 30 may be inserted into an outer shaft 120 where a guide slot 122 may be formed along a circumference direction thereof, and the first wheel 44 is connected to the first cam 42 through the outer shaft 120.

The first cam 42 is connected to and rotated with the outer shaft 120.

A cam pin 48 may be connected to the second cam 52 and the cam pin 48 is inserted into the guide slot 122 for guiding rotation of the second cam 52. A cam hole 43 may be formed to the second cam 52, the cam pin 48 is connected to the cam hole 43 and the cam pin 48 may be movably inserted into the guide slot 122. Thus the second cam 52 is connected to the camshaft 30 through the guide slot 122 and may relatively rotate with respect to the outer shaft 120 along a circumference direction of the outer shaft 120.

A first rocker arm hole 78 is formed to the first rocker arm 70, a second rocker arm hole 88 is formed to the second rocker arm 70 and the rocker shaft 110 is inserted into the first rocker arm hole 78 and the second rocker arm hole 88.

A first roller 76 contacting with the first cam 42 is connected to the end of the first rocker arm 70 and a first bridge 74 is connected to the other end of the first rocker arm 70.

Two first valves 72 may be connected to the first bridge 70.

A second roller 86 contacting with the second cam 52 is connected to the end of the second rocker arm 80 and a second bridge 84 is connected to the other end of the second rocker arm 80.

Two second valves 82 may be connected to the second bridge 80.

That is, the continuous variable valve duration system according to various embodiments of the present invention may be applied to a SOHC engine with light weight and with little driving resistance.

The control portion 100 includes a control gear 102 connected to the eccentric shaft 112 and a control motor 104 selectively rotating the control gear 102. As shown in drawings, an intermediate gear 106 may be interposed between the control gear 102 and the control motor 104.

A guide rail 14 is formed to the cam cap 12 for guiding movement of the slider housing 90. That is, the guide portion 96 contacts with the guide rail 14 and stably guides the movement of the slider housing 90.

Figure 7:
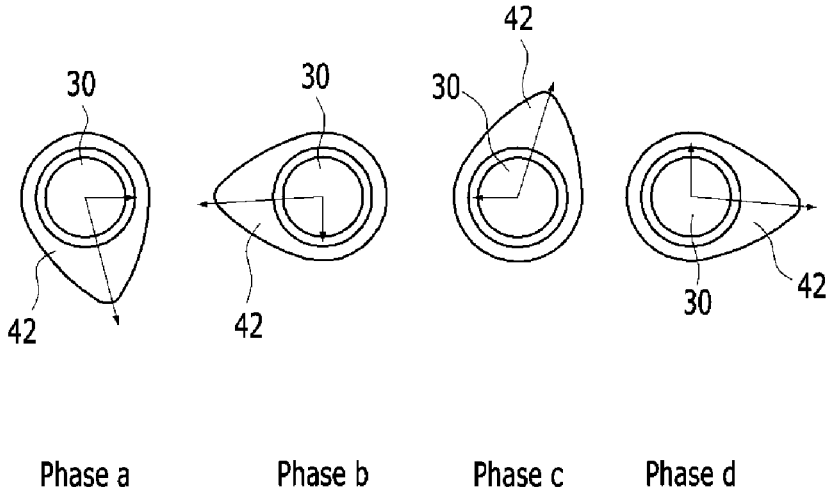
FIG. 7 and FIG. 8 are drawings showing mechanical motions of cams of the exemplary continuous variable valve duration apparatus according to the present invention.
Figure 8:
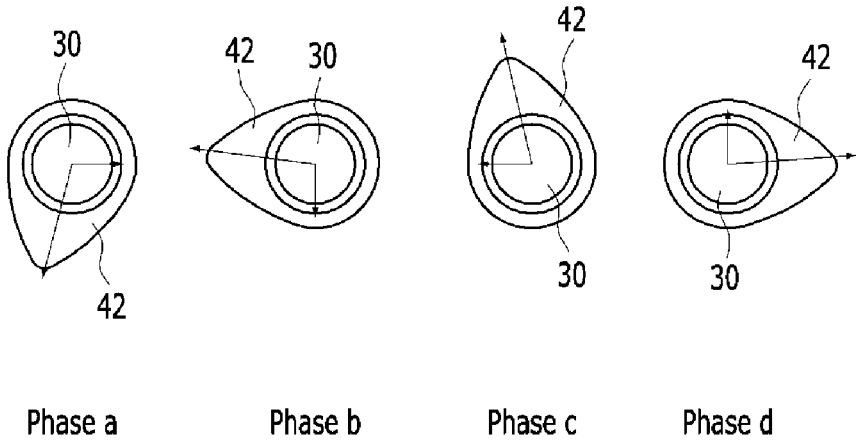

FIG. 7 and FIG. 8 are drawings showing mechanical motions of cams of a continuous variable valve duration apparatus according to various embodiments of the present invention.

Referring to FIG. 1 to FIG. 8, operations of the continuous variable valve duration system according to various aspects of the present invention will be discussed.

When rotation centers of the camshaft 30 and the inner bracket 20 are coincident as shown in FIG. 6A, the first cam 42 rotates with the same phase angle of the camshaft 30. That is, the first cam 42 and the camshaft 30 rotate with the same speed.

When the rotation centers of the camshaft 30 and the inner bracket 20 are not coincident according to operation of the control portion 100 as shown in FIG. 6B, rotation speed of the first cam 42 with respect to rotation speed of the camshaft 30 is changed.

While the connecting pin 54 is rotated together with the camshaft 30, the connecting pin 54 is movable within the pin hole 28, the second slider pin 27 and the first slider pin 25 are rotatable within the second slot 24 and the first slot 22 respectively and the wheel key 46 is movable within the pin slot 26. Thus when the rotation centers of the camshaft 30 and the inner bracket 20 are not coincident, the rotation speed of the first cam 42 with respect to the rotation speed of the camshaft 30 is changed.

As shown in FIG. 7, while the phase angle of the camshaft 30 is constantly changed when the relative rotation center of the inner bracket 20 with respect to the rotation center of the camshaft 30 is changed downward, the rotation speed of the first cam 42 is relatively faster than rotation speed of the camshaft 30 from phase a to phase b and from phase b to phase c, then the rotation speed of the first cam 42 is relatively slower than rotation speed of the camshaft 30 from phase c to phase d and from phase d to phase a.

As shown in FIG. 8, while the phase angle of the camshaft 30 is constantly changed when the relative rotation center of the inner bracket 20 with respect to the rotation center of the camshaft 30 is changed upward, the rotation speed of the first cam 42 is relatively slower than rotation speed of the camshaft 30 from phase a to phase b and from phase b to phase c, then the rotation speed of the first cam 42 is relatively faster than rotation speed of the camshaft 30 from phase c to phase d and from phase d to phase a.

According to the relative position of the inner bracket 20, timing of the first cam 42 to push the first roller 76 that is the timing of the first valve 72 is opened or closed is changed.

FIG. 9 to FIG. 12 are graphs of a valve profile of a continuous variable valve duration apparatus according to various embodiments of the present invention.

The continuous variable valve duration system according to various embodiments of the present invention may perform various valve profiles according to contacting positions of the first cam 42 and the first roller 76, mounting angle of the first cam 42 and the first roller 76 and so on.

Figure 9:
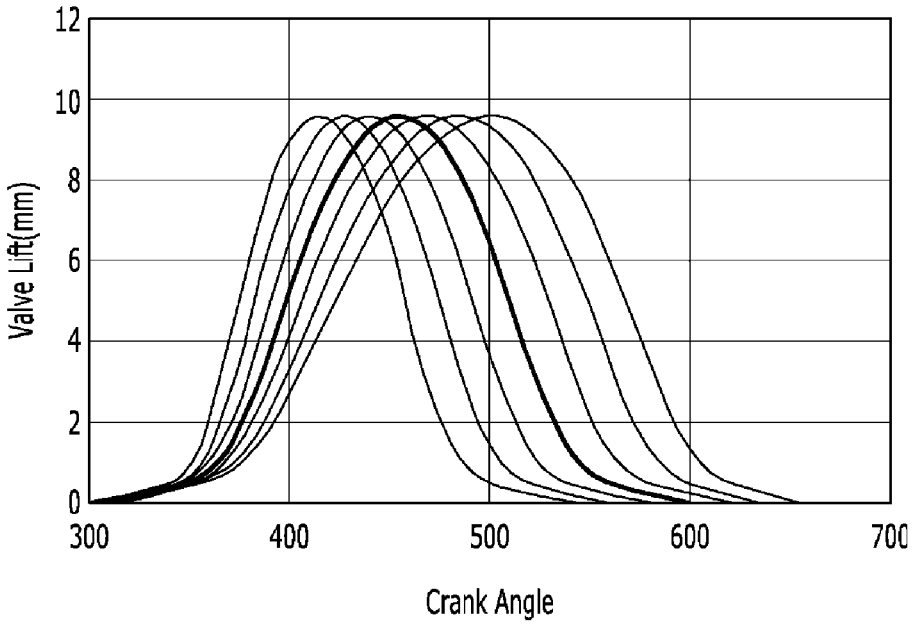
FIG. 9, FIG. 10, FIG. 11, and FIG. 12 are graphs of a valve profile of the exemplary continuous variable valve duration apparatus according to the present invention.
Figure 10:
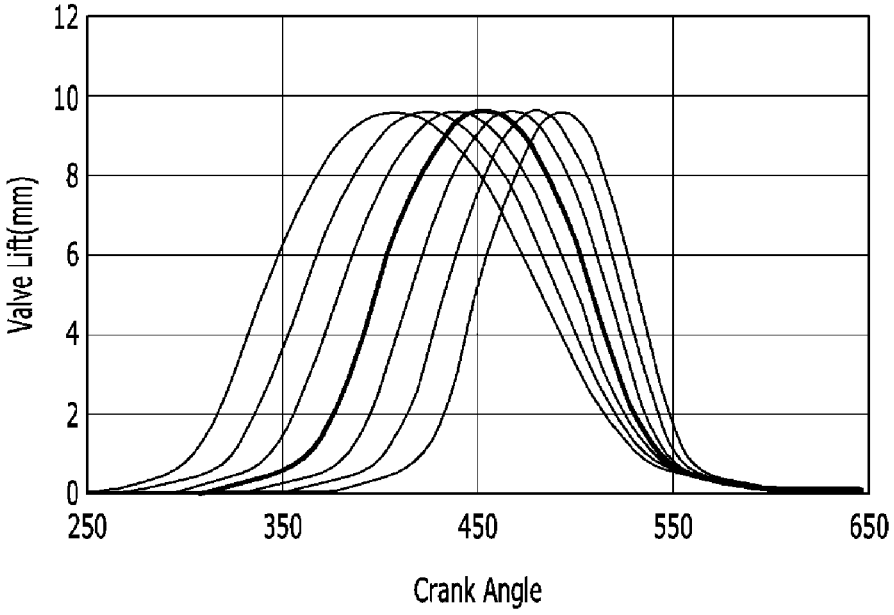

As shown in FIG. 9, opening time of the first valve 72 may be fixed while closing time of the first valve 72 is changed. Or the opening time of the first valve 72 may be changed while the closing time of the first valve 72 is fixed as shown in FIG. 10.

Figure 11:
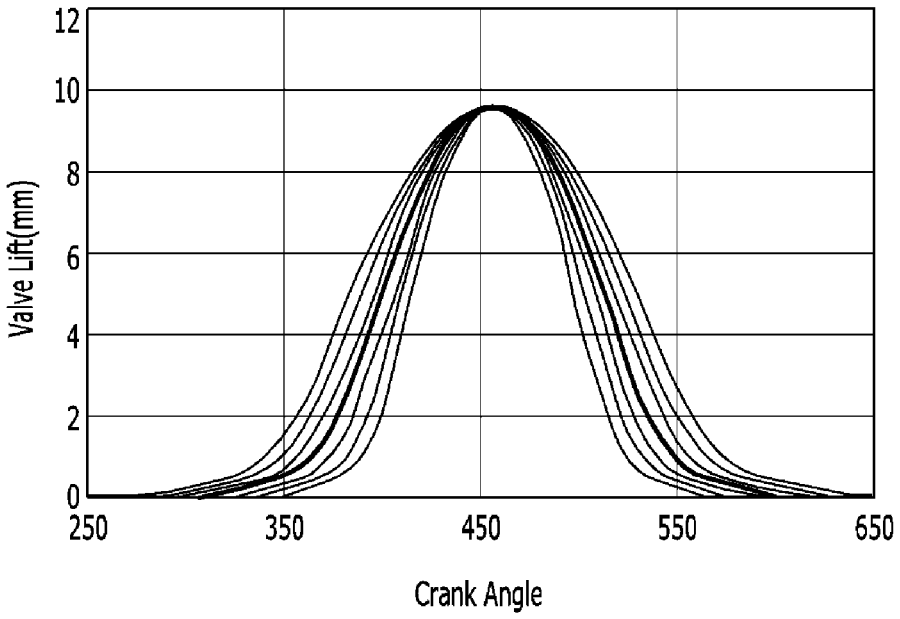
Figure 12:
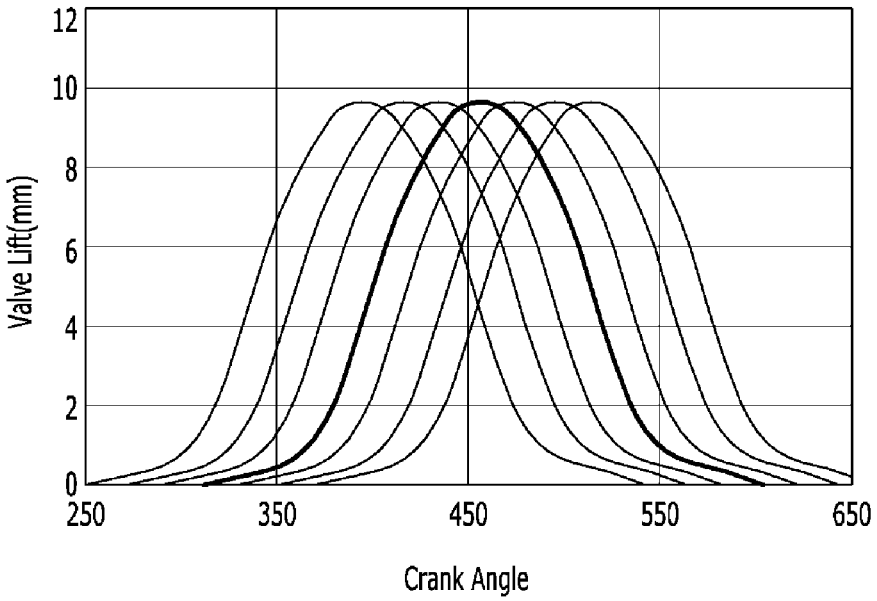

As shown in FIG. 11, peak time of the first valve 72 may be fixed while duration of the first valve 72 is changed. Or closing time and opening time of the first valve 72 simultaneously changed as shown in FIG. 12.

As described above, a continuous variable valve duration system according to various embodiments of the present invention may vary an opening duration of a valve according to operation conditions of an engine, with a simple construction.

The continuous variable valve duration system according to various embodiments of the present invention may be reduced in size and thus the entire height of a valve train may be reduced.

Since the continuous variable valve duration system may be applied to an existing engine without excessive modification, thus productivity may be enhance and production cost may be reduced.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve duration control system comprising:

a camshaft;

a first cam portion including a first cam, into which the camshaft is inserted and of which a relative phase angle of the first cam with respect to the camshaft is variable;

a rocker shaft disposed parallel to the camshaft;

a first rocker arm rotatably disposed to the rocker shaft of which a first end contacts with the first cam and a second end is connected to a first valve;

an inner bracket configured to transmit rotation of the camshaft to the first cam portion;

a slider housing into which the inner bracket is rotatably inserted, on which a control hole is formed and on which a guide portion is formed for guiding movement of the slider housing;

an eccentric shaft inserted into the control hole; and a control portion configured to rotate the eccentric shaft for the slider housing to be moved.

2. The valve duration control system of claim 1, wherein first and second slots are formed to the inner bracket, wherein the first cam portion comprises a wheel on which a wheel key is formed and connected to the first cam, and wherein the valve duration control system further comprises:

a connecting pin connected to the camshaft;

a first slider pin on which a pin slot where the wheel key is slidably inserted thereto along a length direction of the wheel key is formed and the first slider pin is rotatably inserted into the first slot; and a second slider pin on which a pin hole where the connecting pin is slidably inserted thereto along a length direction of the connecting pin is formed and the second slider pin rotatably is inserted into the second slot.

3. The valve duration control system of claim 2, further comprising a bearing disposed between the slider housing and the inner bracket.

4. The valve duration control system of claim 2, wherein the control portion comprises:

a control gear connected to the eccentric shaft; and a control motor configured to rotate the control gear.

5. The valve duration control system of claim 2, further comprising a first bridge connected to the second end of the first rocker arm, wherein two first valves are connected to the first bridge.

6. The valve duration control system of claim 2, further comprising a first roller connected to the first end of the first rocker arm and contacting the first cam.

7. The valve duration control system of claim 2, further comprising an outer shaft and into which the camshaft is inserted, and wherein the first cam is connected to the outer shaft.

8. The valve duration control system of claim 2, further comprising:

a second cam portion including a second cam rotating with the same phase angle of the camshaft; and a second rocker arm rotatably connected to the rocker shaft, a first end of which contacts the second cam and a second end of which is connected with a second valve.

9. The valve duration control system of claim 8, further comprising a second bridge connected to the second end of the second rocker arm, wherein two second valves are connected to the second bridge.

10. The valve duration control system of claim 9, further comprising a second roller connected to the first end of the second rocker arm and contacting the second cam.

11. The valve duration control system of claim 8, further comprising an outer shaft on which a guide slot is formed and into which the camshaft is inserted, and wherein a cam pin is connected to the second cam and the cam pin is inserted into the guide slot for guiding rotation of the second cam, and wherein the first cam is connected to the outer shaft.

12. An engine comprising:

a camshaft;

a first cam portion including a first cam, of which the camshaft is inserted therein and of which relative phase angle of the first cam with respect to the camshaft is variable;

a rocker shaft disposed parallel to the camshaft;

a first rocker arm rotatably disposed on the rocker shaft and of which a first end contacts the first cam and a second end is connected to a first valve;

an inner bracket configured to transmit rotation of the camshaft to the first cam portion;

a slider housing of which the inner bracket is rotatably inserted therein, of which a control hole is formed thereto, and of which a guide portion is formed thereto for guiding movement of the slider housing;

an eccentric shaft inserted into the control hole;

a control portion configured to rotate the eccentric shaft for the slider housing to be moved; and a cam cap supporting the eccentric shaft and mounted to a cylinder head of the engine.

13. The engine of claim 12, wherein first and second slots are formed to the inner bracket, and wherein the first cam portion comprises a wheel of which a wheel key is formed thereto and connected to the first cam, and wherein the engine further comprises:

a connecting pin connected to the camshaft;

a first slider pin on which a pin slot where the wheel key is slidably inserted thereto along a length direction of the wheel key is formed and the first slider pin is rotatably inserted into the first slot; and a second slider pin on which a pin hole where the connecting pin is slidably inserted thereto along a length direction of the connecting pin is formed and the second slider pin is rotatably inserted into the second slot.

14. The engine of claim 13, further comprising a bearing disposed between the slider housing and the inner bracket.

15. The engine of claim 13, wherein the control portion comprises:

a control gear connected to the eccentric shaft; and a control motor configured to rotate the control gear.

16. The engine of claim 13, further comprising a first bridge connected to the second end of the first rocker arm, wherein two first valves are connected to the first bridge.

17. The engine of claim 13, further comprising an outer shaft on which a guide slot is formed and into which the camshaft is inserted, and wherein the first cam is connected to the outer shaft.

18. The engine of claim 17, further comprising:

a second cam portion comprising a second cam connected to the camshaft through the guide slot; and a second rocker arm rotatably connected to the rocker shaft, and of which a first end contacts the second cam and a second end is connected with a second valve.

19. The engine of claim 18, further comprising a second bridge connected to the second end of the second rocker arm, and wherein two second valves are connected to the second bridge.

20. The engine of claim 19, further comprising:

a first roller connected to the first end of the first rocker arm and contacting the first cam; and a second roller connected to the first end of the second rocker arm and contacting with the second cam.

21. The engine of claim 12, wherein a guide rail is formed to the cam cap for guiding movement of the slider housing.

* * * * *